US011345540B1

(12) United States Patent
DiBartolo

(10) Patent No.: US 11,345,540 B1
(45) Date of Patent: May 31, 2022

(54) LOCKING CONTAINER LID WITH ACTUATING HANDLE

(71) Applicant: Nicholas DiBartolo, Bohemia, NY (US)

(72) Inventor: Nicholas DiBartolo, Bohemia, NY (US)

( * ) Notice: Subject to any disclaimer, the term of this patent is extended or adjusted under 35 U.S.C. 154(b) by 6 days.

(21) Appl. No.: 16/661,858

(22) Filed: Oct. 23, 2019

(51) Int. Cl.
*B65D 45/28* (2006.01)
*B65F 1/16* (2006.01)

(52) U.S. Cl.
CPC ..... *B65F 1/1615* (2013.01); *B65F 1/1623* (2013.01); *B65F 2210/148* (2013.01)

(58) Field of Classification Search
CPC ..... B65F 1/1615; B65F 1/1623; B65F 2210/148; B65D 55/10; E05B 65/5292
USPC ..... 220/212.5, 908, 318
See application file for complete search history.

(56) References Cited

U.S. PATENT DOCUMENTS

| | | | | |
|---|---|---|---|---|
| 1,197,560 | A | 9/1916 | Smith | |
| 2,153,916 | A * | 4/1939 | Dunbar | B65D 55/10 292/38 |
| 2,238,379 | A | 4/1941 | Tiffany | |
| 2,632,580 | A | 3/1953 | Biddlecombe | |
| 2,654,623 | A | 10/1953 | Huggins | |
| 2,694,589 | A | 11/1954 | Dayley | |
| 2,974,990 | A | 3/1961 | Mereness | |
| 3,124,381 | A | 3/1964 | Geldart | |
| 3,589,760 | A | 6/1971 | Williams | |
| 3,674,298 | A | 7/1972 | Vekony | |
| 3,817,563 | A | 6/1974 | McGlothlin | |
| 4,384,656 | A | 5/1983 | McQuiston et al. | |
| 4,534,488 | A | 8/1985 | Boggs et al. | |
| 4,819,827 | A | 4/1989 | Disesa | |
| 5,004,114 | A | 4/1991 | Terbrusch et al. | |
| 5,118,144 | A | 6/1992 | Garofalo | |
| 5,160,060 | A | 11/1992 | Garofalo | |
| D333,715 | S | 3/1993 | Mahler | |
| 5,772,264 | A | 6/1998 | Bettenhausen | |
| 6,230,920 | B1 | 5/2001 | Porter | |

(Continued)

FOREIGN PATENT DOCUMENTS

| | | |
|---|---|---|
| CA | 2574696 A1 | 7/2007 |
| EP | 0856478 A1 | 8/1998 |

*Primary Examiner* — Don M Anderson
*Assistant Examiner* — Elizabeth J Volz
(74) *Attorney, Agent, or Firm* — The Law Office of Daniel T. Weglarz, P.C.

(57) ABSTRACT

A locking container lid with actuating handle and an accompanying container to which the locking container lid is able to be selectively secured. The locking container lid with actuating system that includes a spring-loaded handle and an alignment system that ensures the handle can only be actuated when the container lid is upright. It also has a locking mechanism that includes spring-loaded opposing locking wings that move laterally and are sized to engage substantially more than half of the rim of the accompanying container when in a locked position. The locking container lid with actuating handle and accompanying container are structured so that once it is locked on the accompanying container, the locking container lid can freely rotate around the accompanying container but cannot be lifted off absent actuation of the actuating handle while the container lid and accompanying container are standing upright.

20 Claims, 5 Drawing Sheets

(56) References Cited

U.S. PATENT DOCUMENTS

| | | | | |
|---|---|---|---|---|
| 6,666,485 | B1 | 12/2003 | Moret | |
| 7,556,169 | B2 | 7/2009 | Cooper et al. | |
| 7,748,558 | B2 | 7/2010 | Rouns | |
| 7,806,287 | B2 | 10/2010 | Rouns | |
| 2006/0191938 | A1 | 8/2006 | Zephir et al. | |
| 2007/0175898 | A1 | 8/2007 | Craft et al. | |
| 2007/0228043 | A1 | 10/2007 | Perruccio | |
| 2015/0090719 | A1 | 4/2015 | Lyon | |
| 2016/0159570 | A1* | 6/2016 | Reeb | E05B 15/0086 220/324 |

* cited by examiner

LOCKING CONTAINER LID WITH ACTUATING HANDLE

BACKGROUND OF THE INVENTION

Field of the Invention

This invention relates to a locking container lid for a container, such as a refuse container, which is structured and operative to restrict access to the contents of the container.

Description of the Prior Art

Containers, which are commonly understood to be receptacles or enclosures for holding one or many items in storage, have been used since prehistoric times and remain ubiquitous in human societies. While all containers generally provide an enclosed space that can be used to contain, store, and/or transport things, it is common for containers to be classified by what items they are intended to contain or store. And along the same lines, based on the intended use, a particular classification of container may include certain design adaptations that make it more suitable for such a use.

For example, a container may be classified as a household refuse container (or waste containers, trash cans, or garbage cans) if its intended use is to temporarily hold and store household waste. And household refuse containers commonly include certain aspects that allow them to securely hold waste items to prevent unauthorized access to the contents and to facilitate periodic emptying of waste items therein. Indeed, the design of household refuse containers with removable lids and one or more handling mechanisms is generally well established.

Nonetheless, a problem that still exists with household refuse containers, or any other container that needs to selectively prevent unauthorized access to its contents by way of a removable lid, is that such removable lids are often so easy to dislodge or remove that they fail to prevent such access. For example, it is common in many areas for rodents and other animals to simply lift or remove lids to dig into refuse containers that are stored outdoors. Thus, there remains a need for a locking container lid that can be used with an accompanying refuse container (or another type container) and prevent unauthorized access. It would be desirable if such a locking container lid included an actuating handle that operates in a momentary fashion to disengage the locking mechanism of the container lid. It would be additionally desirable for such a locking container with actuating handle to include an alignment system in the actuating handle that operates to disable the actuating handle when the container lid is not upright in order to ensure the container lid cannot be removed unless the lid and container is in a standing, upright position.

SUMMARY OF THE INVENTION

The present disclosure provides for a locking container lid with actuating handle, comprising: a container lid configured to be positioned on top of an accompanying container; a locking mechanism integral with the container lid, wherein the locking mechanism includes at least one locking member that is biased to a locked position and moveable between the locked position and an unlocked position; an actuating system which is integral with the container lid and includes at least a handle that is biased to a handle locked position and moveable between the handle locked position and a handle unlocked position through an application of mechanical force, wherein the actuating system is integral with the locking mechanism such that moving the handle to the handle unlocked position causes the at least one locking member to move to the unlocked position; and wherein when the container lid and locking mechanism are configured such that when the container lid is placed on top of the accompanying container with the at least one locking member in the unlocked position and then the at least one locking member is allowed to move to the locked position, the at least one locking member engages the accompanying container in a manner that secures the container lid to the accompanying container.

Embodiments of the present disclosure may further include an alignment system integral with the actuating system, wherein the alignment system selectively prevents the handle from moving to the handle unlocked position.

It is an object of this invention to provide a locking container lid that can be used with an accompanying refuse container (or another type container) and prevent unauthorized access.

It is another object of this invention to provide a locking container lid that includes an actuating handle that operates in a momentary fashion to disengage the locking mechanism of the container lid.

It is yet another object of this invention to provide a locking container lid with an actuating handle that includes an alignment system in the actuating handle that operates to disable the actuating handle when the container lid is not upright.

These and other objects will be apparent to one of skill in the art.

DETAILED DESCRIPTION OF THE INVENTION

Disclosed herein is a locking container lid with actuating handle as well as an accompanying container to which the locking container lid is able to be selectively secured. The locking container lid with actuating handle of the present disclosure includes a spring-loaded handle that can only be actuated when the lid is upright. It also has spring-loaded opposing locking wings that move laterally and are sized to engage substantially more than half of the accompanying container when in a locked position. The locking container lid with actuating handle and accompanying container are structured so that the locking container lid does not need to be aligned a particular way in order to be placed on the accompanying container and, once it is locked on the accompanying container, the locking container lid can freely rotate but cannot be lifted off absent actuation of the actuating handle.

Figure 1:
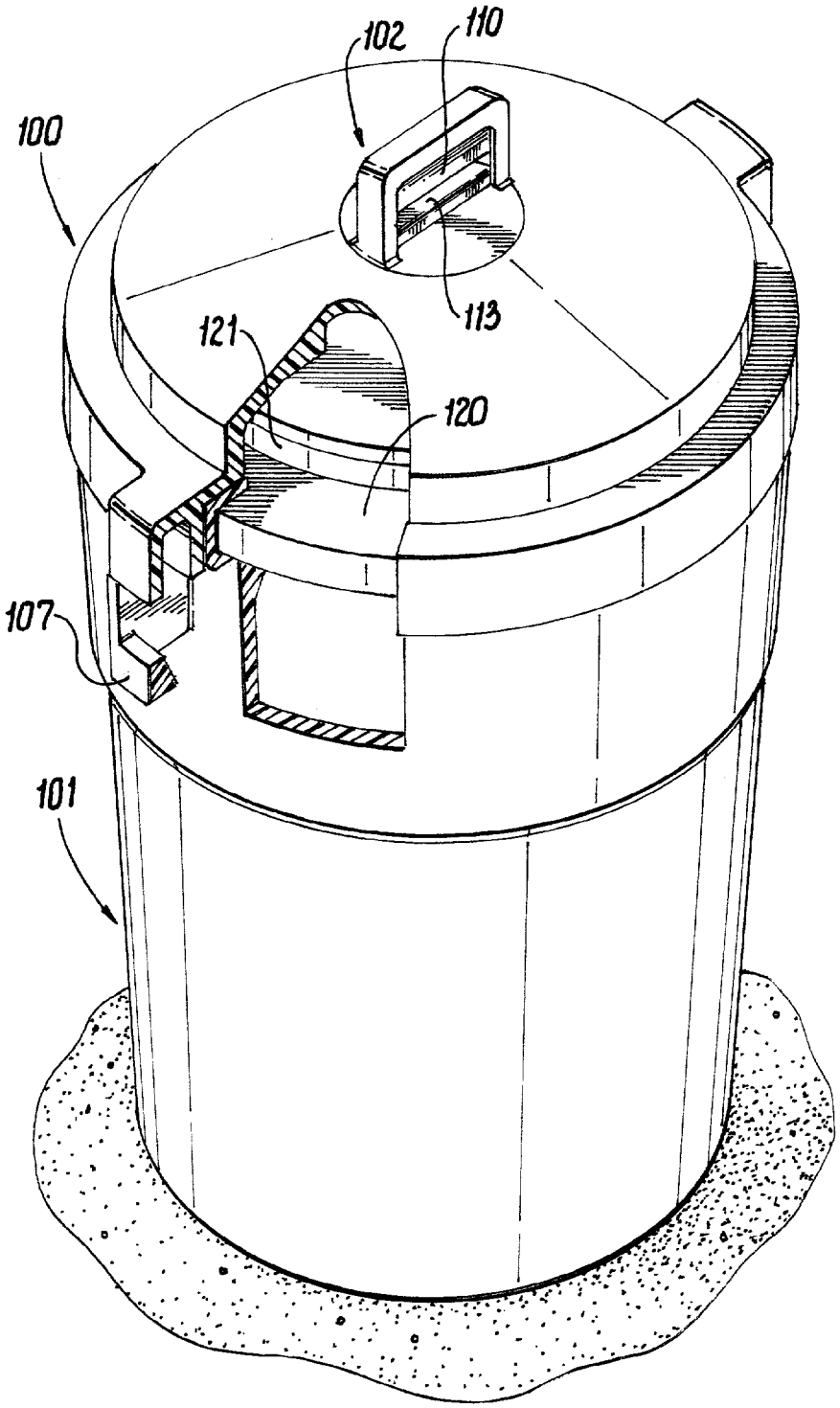
FIG. 1 is a front perspective view of a locking container lid with actuating handle built in accordance with the present invention shown with an accompanying container and the actuating handle in a locked position.

Referring now to the drawings and, in particular, FIGS. 1, 2*a*, 2*b*, 3, 4, 5, and 6, various aspects of a locking container lid 100 with actuating handle 110 are shown both with and without an accompanying container 101. In FIG. 1, the container lid 100 is shown secured to the accompanying container 101 with both items positioned standing upright. The actuating handle 110 is built into a top handle portion 102 of the container lid 100 and is shown in a locked position. As described in greater detail below, the actuating handle 110 is spring biased to the locked position and, when the actuating handle 110 is in place on top of the accompanying container 101 and in the locked position, the container lid 100 is locked onto the accompanying container 101.

Figure 2A:
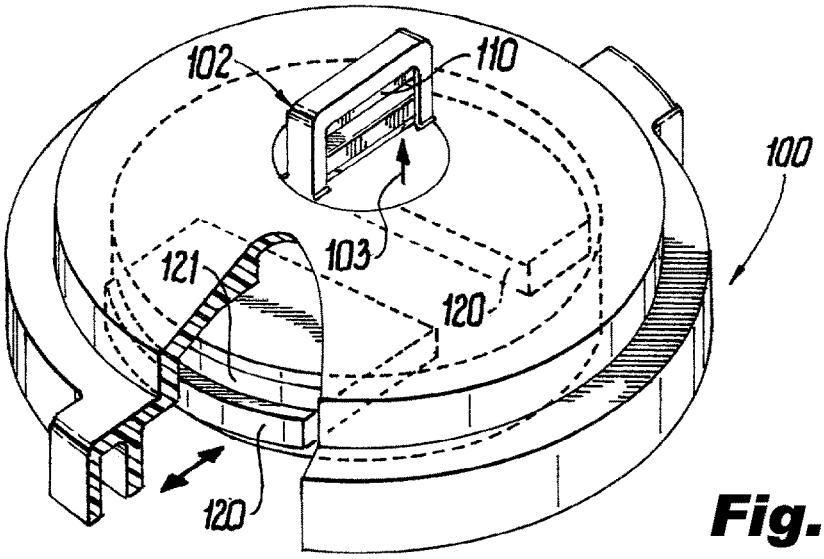
FIG. 2*a* is a front perspective view of a locking container lid with actuating handle built in accordance with the present invention shown with the actuating handle in an unlocked position.
Figure 2B:
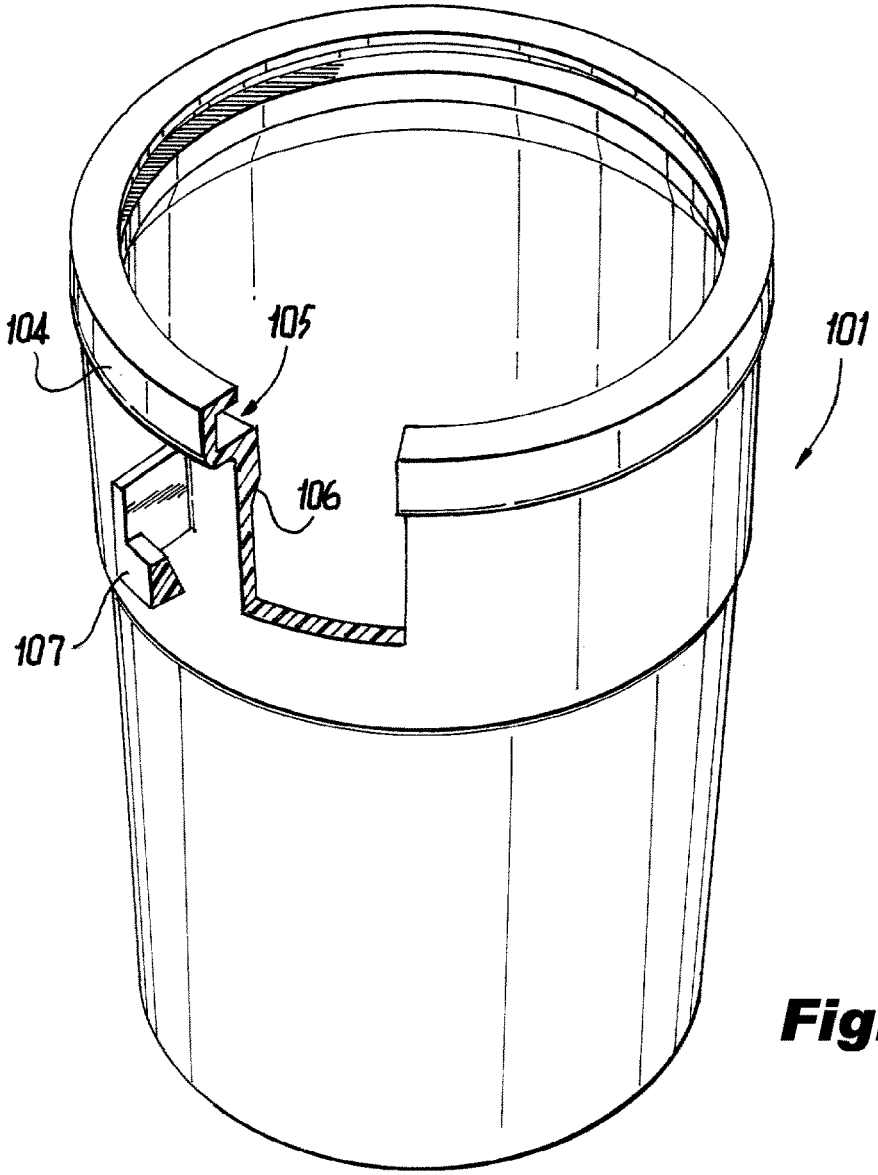
FIG. 2*b* is a front perspective view of an accompanying container built in accordance with the present invention.

When sufficient mechanical force to overcome the spring biasing in the actuating handle is exerted in an actuating direction 103 on the actuating handle 110, and the container lid 100 is upright (as discussed below with reference to FIG. 4), the actuating handle 110 may be depressed into the top handle portion 102 and thereby moved to its unlocked position. The actuating handle 110 in its unlocked position is illustrated in FIG. 2*a*. FIG. 2*b* shows the accompanying container 101, which may be embodied as a rigid, cylindrical can with a continuous sidewall, a closed bottom, and an open top. Extending around its entire exterior, the accompanying container 101 includes a protruding lip 104 positioned at the top end of the sidewall, adjacent to the open top. On its interior, the space formed by the protruding lip 104 forms a locking slot 105, which extends around the entire interior of the accompanying container 101 as well. Also extending around the entire interior, positioned directly beneath the locking slot 105, is a slanted portion 106, which is angled to prevent items such as trash from getting stuck near the locking slot 105.

The accompanying container 101 may additionally include a pair of handles 107 to make it easier to move and lift. The accompanying container 101 may also be tethered to the container lid 100 through a steel cable tether 108.

Figure 3:
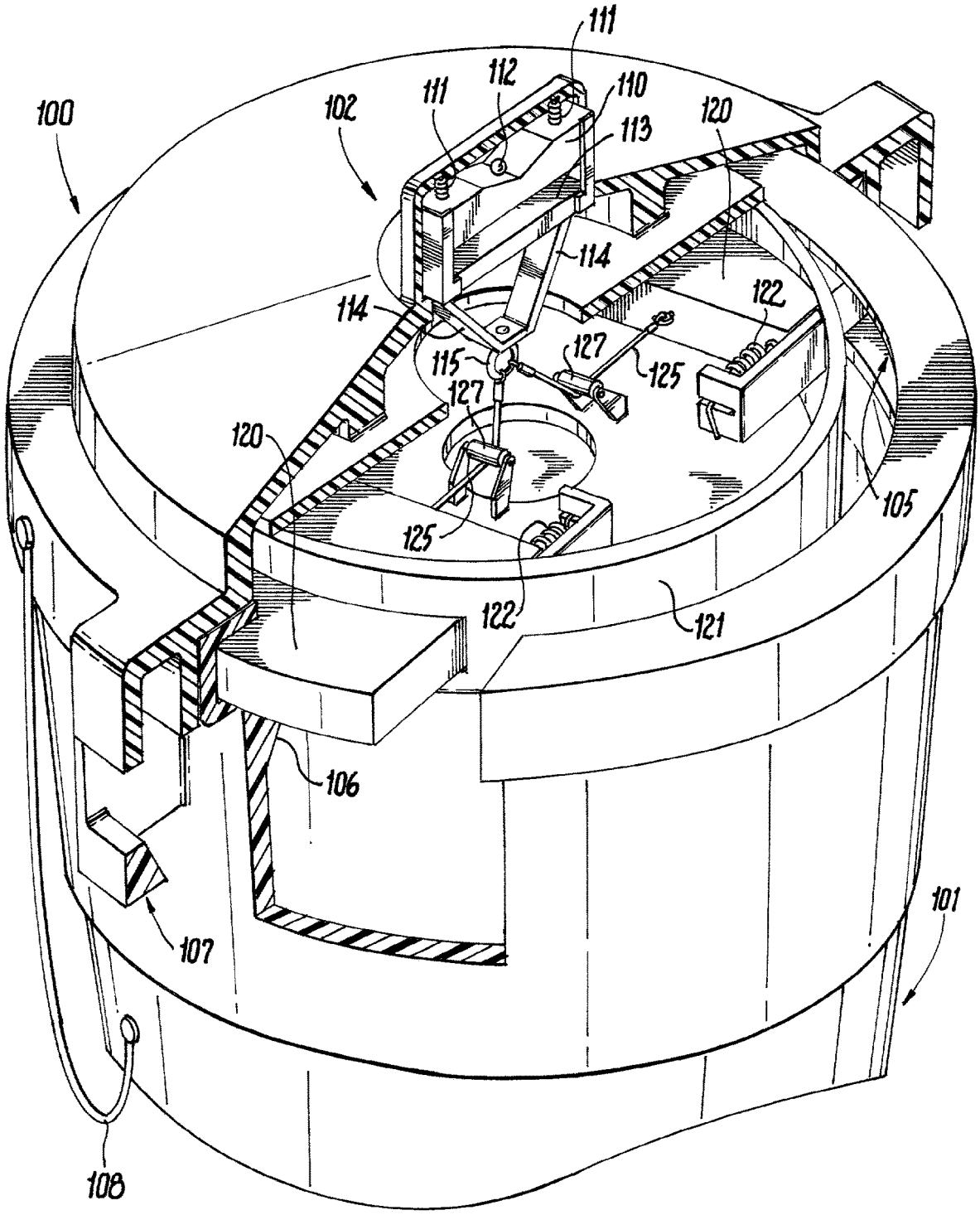
FIG. 3 is a front perspective view of a locking container lid with actuating handle built in accordance with the present invention shown with an accompanying container and the actuating handle in a locked position.
Figure 4:
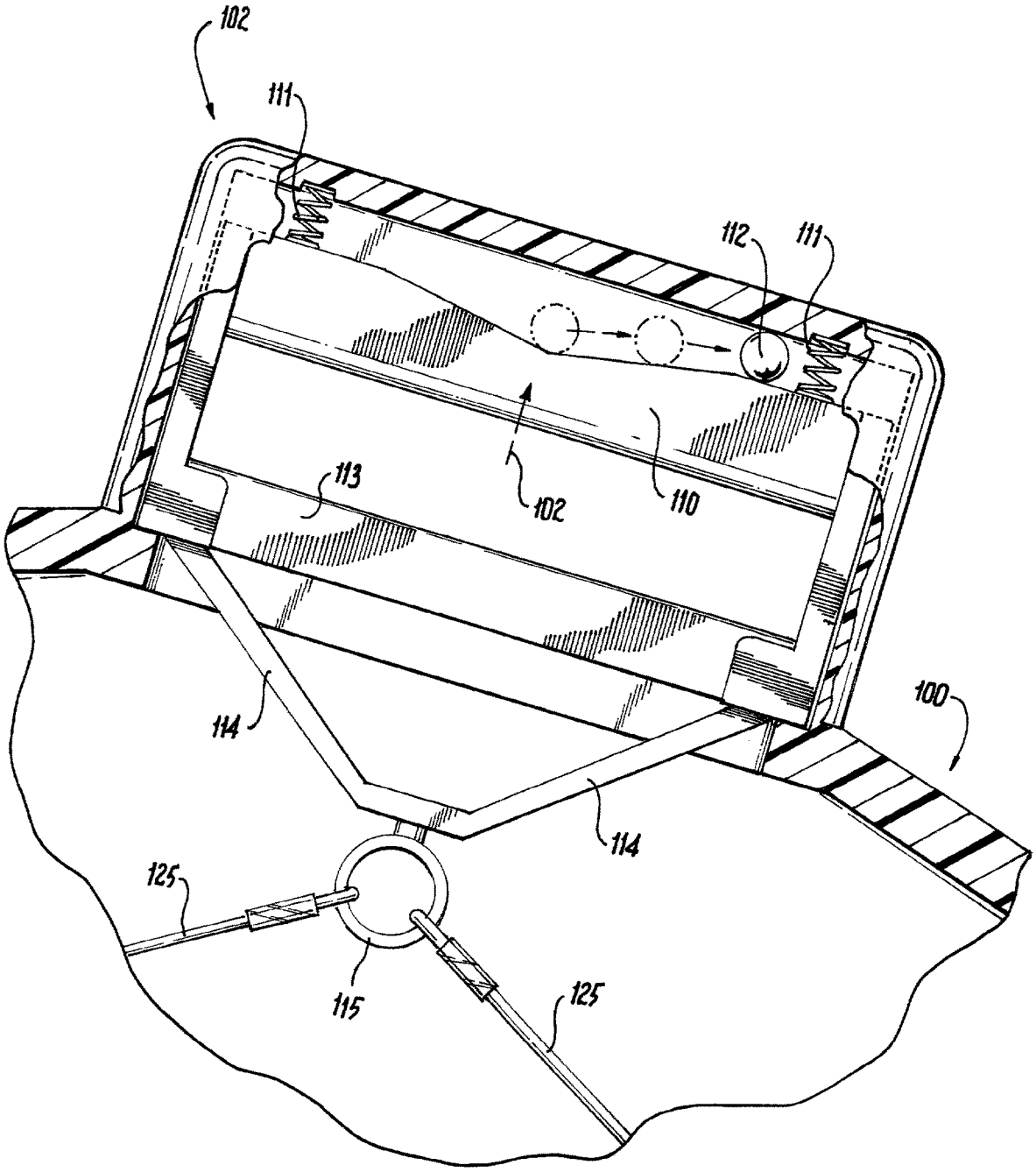
FIG. 4 is a partial side elevation view of a cross section of a locking container lid with actuating handle built in accordance with the present invention shown with the actuating handle in a locked position.
Figure 5:
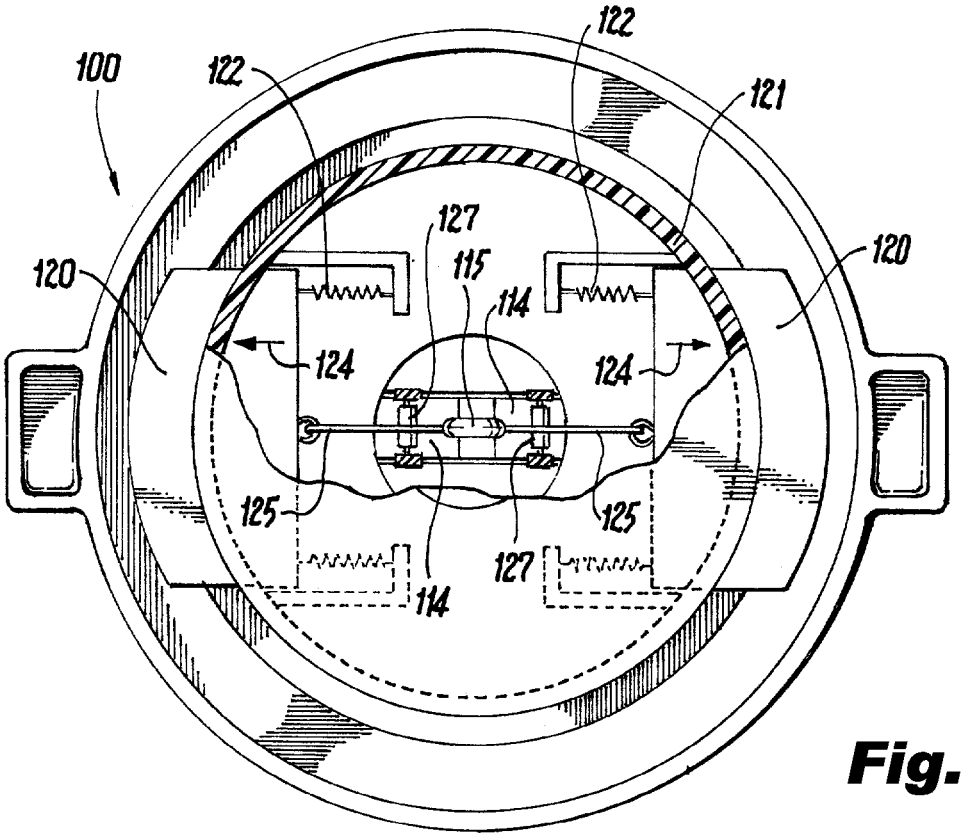
FIG. 5 is a bottom plan view of a cross section of a locking container lid with actuating handle built in accordance with the present invention shown with the locking mechanism in a locked position.
Figure 6:
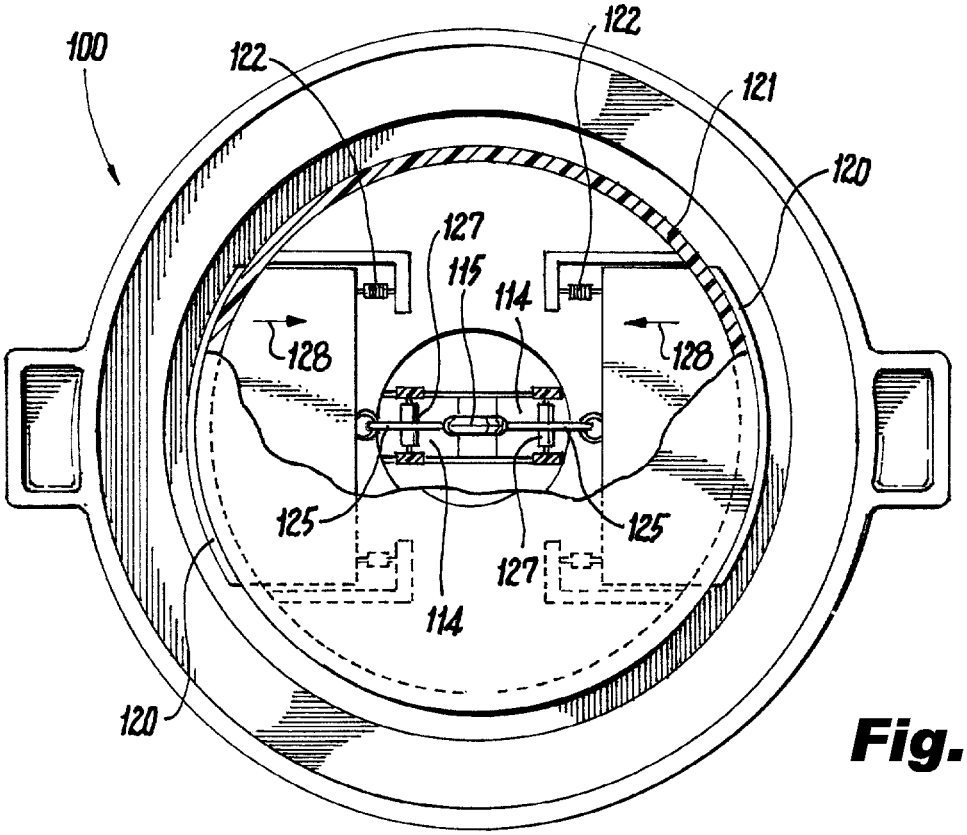
FIG. 6 is a bottom plan view of a cross section of a locking container lid with actuating handle built in accordance with the present invention shown with the locking mechanism in an unlocked position.

Shown in FIGS. 3 and 4 are the components with which the actuating handle 110 operates and the alignment system. The actuating handle 110 operates with a pair of handle springs 111 that bias the actuating handle 110 to the locked position. The top side of the actuating handle 110, which faces the bottom side of the top handle portion 102, includes two angled surfaces that meet to form an obtuse angle that forms a low point at the middle of the top side of the actuating handle 110. A free moving (meaning it is not tethered or attached to anything) locking ball 112 is disposed in a space between the bottom side of the top handle portion 102 and the top side of the actuating handle 110. The locking ball 112, together with the shape of the top side of the actuating handle 110, form the alignment system of the actuating handle 110, operating to prevent the actuating handle 110 from being depressed into the top handle portion 102 and moved to its unlocked position unless the locking ball 112 is resting in or directly adjacent to the low point at the middle of the top side of the actuating handle 110. Since the two angled surfaces on the top side of the actuating handle 110 slope towards the low point, when the actuating handle 110 is upright, as illustrated in FIG. 3, the locking ball 112 is caused to move to the low point under the force of gravity. But, whenever the actuating handle 110 is not upright, as exemplified in FIG. 4, the locking ball 112 is caused to move out of the location of the obtuse angle at the middle of the top side of the actuating handle 110 under the force of gravity.

The actuating handle 110 is mechanically connected with a bottom handle portion 113 such that, as the actuating handle 110 moves in the actuating direction 103 (and moves away from the actuating direction), the bottom handle portion 113 moves with it. The bottom handle portion 113 includes a downward extension portion that may be embodied by two angled downward extenders 114 that extend into the container lid 100 and are fixedly connected to an attachment ring 115 that may thereby be held in a central position inside the container lid 100.

Shown in FIGS. 2*a*, 3, 5, and 6 is a locking mechanism of the container lid 100. The locking mechanism includes a pair of locking wings 120, a locking housing 121, a pair of wing springs 122, and a cable system. The locking wings 120 are spring biased in an extending direction 124 by the wing springs 122, which may be attached to the inside of the locking housing 121. The locking wings 120 are sized to slide into the locking slot 105 of an accompanying container 101 when the container lid 100 is placed on the accompanying container in order to secure the container lid 100 thereto.

The cable system includes two cable members 125 that each attach to and extend downwardly from the attachment ring 115 to its own discrete pulley 127, and then connect to one of the locking wings 120. In this regard, the cable members 125 and the pulleys 127 of the cable system operate to transfer vertical motion from the actuating handle 110 to the locking wings 120 as lateral motion. More specifically, the connection of the cable members 125 to the attachment ring 115 enables a transfer of vertical motion from the actuating handle 110 to the cable members 125. Further, the pulleys 127 operate to convert the vertical motion in the respective cable members 125 from the actuating handle 110 to horizontal motion before the respective cable members 125 attach to the locking wings 120. Thus, by way of the cable system, moving the actuating handle 110 in an actuating direction 103 with sufficient mechanical force to overcome the spring bias in the actuating handle 110 causes the locking wings 120 to overcome their bias in the extending direction 124 and move in a receding direction 128, thereby causing the locking mechanism to enter its unlocked position.

The container lid 100 and the accompanying container 101 may be constructed out of a polyvinyl chloride (or PVC). The various springs, the locking ball 112, and components of the cable system may be constructed out of steel.

Advantageously, with the integrated locking mechanism and alignment system, the container lid 100 essentially can be removed only by a human. Furthermore, it is appreciated that the substantially cone shape of the container lid 100 will help prevent animals from sitting on top.

It is appreciated, however, that unlike some existing locking refuse container lids, the integrated locking mechanism and alignment system of the present disclosure do not result in the container lid 100 being so locked down that it cannot be easily removed with one hand by an adult human (as long as the container lid 100 is upright). However, when the container lid 100 and accompanying container 101 are positioned laying sideways on the ground, such as after being knocked over by an animal, which is when many existing refuse containers are most vulnerable to unwanted entry by animals, the alignment system operates to prevent the actuating handle 110 from occupying its unlocked position to prevent removal of the container lid 100 from the accompanying container 101.

It is appreciated that the shape of the locking wings 120 allow them to engage with much more of the locking slot 105 of the accompanying can 101 and provide for better holding strength. Indeed, the locking wings 120 may be sized to engage with more than 50% of the locking slot 105 at the rim of an accompanying can 101, even up to 70% in some embodiments.

Also, because the locking wings 120 sufficiently recede into the locking housing 121 when the locking mechanism is in its unlocked position, the container lid 100 advantageously does not have to be lined up in a particular way in order to be placed on an accompanying can 101.

It will be understood that many additional changes in the details, materials, steps and arrangement of parts, which have been herein described and illustrated to explain the nature of the invention, may be made by those skilled in the art within the principle and scope of the invention as expressed in the appended claims.

What is claimed is:

1. A locking container lid with actuating handle, comprising:

a container lid configured to be positioned on top of an accompanying container;

a locking mechanism integral with the container lid, wherein the locking mechanism includes at least one pair of locking members that is are each biased to a locked position in which they extend from portions of the container lid in opposite directions and moveable between the locked position and an unlocked position;

an actuating system that is integral with the container lid and includes at least a handle that is biased to a handle locked position and moveable between the handle locked position and a handle unlocked position through an application of mechanical force, wherein the actuating system is integral with the locking mechanism such that moving the handle to the handle unlocked position causes the at least one pair of locking members to move to the unlocked position;

an alignment system integral with the actuating system, wherein the alignment system selectively prevents the handle from moving to the handle unlocked position unless the container lid is upright; and wherein the container lid and locking mechanism are configured such that when the container lid is placed on top of the accompanying container with the at least one pair of locking members in the unlocked position, and then the at least one pair of locking members are is allowed to move to the locked position, the at least one locking member engages the accompanying container in a manner that secures the container lid to the accompanying container.

2. The locking container lid with actuating handle of claim 1, additionally comprising a transferring system integral with the actuating system and the locking mechanism, wherein the transferring system is configured to transfer motion from the handle moving toward the handle unlocking direction to the at least one pair of locking members in a manner that causes the at least one pair of locking members to each move toward the unlocked position.

3. The locking container lid with actuating handle of claim 2, wherein the transferring system is defined by a cable system.

4. The locking container lid with actuating handle of claim 1, wherein the container lid and the accompanying container each have a circular profile and movement of the at least one pair of locking members from the unlocked position to the locked position causes the at least one pair of locking members to extend radially from portions of the container lid.

5. The locking container lid with actuating handle of claim 4, wherein the accompanying container includes a locking slot which extends entirely around a circumference of an interior surface of the accompanying container and moving the at least one pair of locking members from the unlocked position to the locked position causes the at least one pair of locking members to extend radially from portions of the container lid into the locking slot.

6. A locking container lid with actuating handle, comprising:

a container lid configured to be positioned on top of an accompanying container;

a locking mechanism integral with the container lid, wherein the locking mechanism includes a pair of locking wings that are biased to a locked position in which they extend from portions of the container lid in opposite directions and moveable between the locked position and an unlocked position;

an actuating system that is integral with the container lid and includes at least a handle that is biased to a handle locked position and moveable between the handle locked position and a handle unlocked position through an application of mechanical force, wherein the actuating system is integral with the locking mechanism such that moving the handle to the handle unlocked position causes the locking mechanism to move to the unlocked position;

wherein the container lid and the accompanying container each have a circular profile and movement of the locking wings from the unlocked position to the locked position causes the locking wings to extend radially from portions of the container lid;

wherein the accompanying container includes a locking slot which extends entirely around a circumference of an interior surface of the accompanying container and moving the locking wings from the unlocked position to the locked position causes the locking wings to extend radially from portions of the container lid into the locking slot; and wherein the container lid and locking mechanism are configured such that when the container lid is placed on top of the accompanying container with the locking mechanism in the unlocked position, and then the locking mechanism is allowed to move to the locked position, the locking mechanism engages the accompanying container in a manner that secures the container lid to the accompanying container.

7. The locking container lid with actuating handle of claim 6, wherein the locking wings are mirror image structures.

8. The locking container lid with actuating handle of claim 6, additionally comprising an alignment system integral with the actuating system, wherein the alignment system selectively prevents the handle from moving to the handle unlocked position.

9. The locking container lid with actuating handle of claim 8, wherein the alignment system prevents the handle from moving to the handle unlocked position unless the container lid is upright.

10. The locking container lid with actuating handle of claim 8, wherein the alignment system includes a free moving locking element that is adjacent to the handle and blocks the path of the handle moving to the handle unlocked position unless the container lid is upright.

11. The locking container lid with actuating handle of claim 6, additionally comprising a transferring system integral with the actuating system and the locking mechanism, wherein the transferring system is configured to transfer motion from the handle moving toward the handle unlocking direction to the locking wings in a manner that causes the locking wings to move toward the unlocked position.

12. The locking container lid with actuating handle of claim 11, wherein the transferring system is defined by a cable system.

13. A locking container lid with actuating handle for use with an accompanying container, comprising:

a container lid configured to be positioned on top of an accompanying container, wherein the container lid and the accompanying container each have a circular profile and the accompanying container includes a locking slot adjacent to a rim on the accompanying container which extends around the entire circumference of the accompanying container;

a locking mechanism integral with the container lid, wherein the locking mechanism includes at least one locking member that is biased to a locked position and moveable between the locked position and an unlocked position;

an actuating system that is integral with the container lid and includes at least a handle that is biased to a handle locked position and moveable between the handle locked position and a handle unlocked position through an application of mechanical force, wherein the actuating system is integral with the locking mechanism such that moving the handle to the handle unlocked position causes the at least one locking member to move to the unlocked position;

an alignment system integral with the actuating system, wherein the alignment system selectively prevents the handle from moving to the handle unlocked position; and wherein the container lid and locking mechanism are configured such that when the container lid is placed on top of the accompanying container with the at least one pair of locking members in the unlocked position, and then the at least one pair of locking members are is allowed to move to the locked position, the at least one locking member engages the locking slot of the accompanying container in a manner that secures the container lid to the accompanying container.

14. The locking container lid with actuating handle for use with an accompanying container of claim 13, wherein movement of the at least one locking member from the unlocked position to the locked position while the container lid is placed on the accompanying container causes the at least one locking member to extend radially from portions of the container lid into the locking slot adjacent to a rim on the accompanying container.

15. The locking container lid with actuating handle for use with an accompanying container of claim 14, wherein the at least one locking member is defined by a pair of locking wings that together engage more than half of the locking slot when the container lid is placed on the accompanying container and the locking wings are extended into the locking slot.

16. The locking container lid with actuating handle of claim 15, wherein the locking wings are mirror image structures.

17. The locking container lid with actuating handle for use with an accompanying container of claim 13, wherein the alignment system prevents the handle from moving to the handle unlocked position unless the container lid is upright.

18. The locking container lid with actuating handle of claim 13, wherein the alignment system includes a free moving locking element that is adjacent to the handle and blocks the path of the handle moving to the handle unlocked position unless the container lid is upright.

19. The locking container lid with actuating handle of claim 13, additionally comprising a transferring system integral with the actuating system and the locking mechanism, wherein the transferring system is configured to transfer motion from the handle moving toward the handle unlocking direction to the at least one locking member in a manner that causes the at least one locking member to move toward the unlocked position.

20. The locking container lid with actuating handle of claim 19, wherein the transferring system is defined by a cable system.

* * * * *